United States Patent [19]

Arai et al.

[11] 4,431,298

[45] Feb. 14, 1984

[54] APPARATUS FOR BRUSH DEVELOPMENT INCLUDING MEANS FOR DETECTING TONER IN THE TONER BATH AND MEANS FOR SUPPLYING TONER TO THE TONER BATH

[75] Inventors: Minoru Arai, Kumagaya; Keitaro Yamashita, Saitama, both of Japan

[73] Assignee: Hitachi Metals, Ltd., Tokyo, Japan

[21] Appl. No.: 336,066

[22] Filed: Dec. 31, 1981

[30] Foreign Application Priority Data

Jan. 23, 1981 [JP] Japan ..... 56-8669

[51] Int. Cl.[3] ..... G03G 15/09

[52] U.S. Cl. ..... 355/3 DD; 118/688; 118/658; 222/DIG. 1

[58] Field of Search ..... 355/3 DD, 14 D; 118/688, 693, 656–658, 689; 222/DIG. 1

[56] References Cited

U.S. PATENT DOCUMENTS

| | | | |
|---|---|---|---|
| 3,948,217 | 4/1976 | Forward | 355/3 DD |
| 3,951,309 | 4/1976 | Kadowaki | 222/DIG. 1 |
| 4.007,707 | 2/1977 | Buchan et al. | 355/3 DD |
| 4,181,422 | 1/1980 | Forgo et al. | 355/3 DD |
| 4,240,375 | 12/1980 | Terashima | 355/3 DD |
| 4,270,487 | 6/1981 | Terashima et al. | 355/3 DD |

*Primary Examiner*—R. L. Moses

*Attorney, Agent, or Firm*—Antonelli, Terry & Wands

[57] ABSTRACT

A developing apparatus is disclosed which has a toner bath with a magnetic toner placed therein, the toner being supplied via a developing role to a developing gap between an image carrying substance and the developing roll, and a toner supply bath for supplying the magnetic toner to the toner bath, a latent image formed on the image carrying substance being developed with the magnetic toner by means of a magnetic brush development. The developing apparatus has a detector member for generating a signal when the magnetic toner is absent in the toner bath, a drive member which responds to the signal generated from the detector member, and a magnetic field generating device driven by the drive member for magnetically shutting off a supply path provided between the toner supply bath and toner bath when the detector member generates no signal, but magnetically opening the supply path when the detector member generates the signal.

8 Claims, 4 Drawing Figures

APPARATUS FOR BRUSH DEVELOPMENT INCLUDING MEANS FOR DETECTING TONER IN THE TONER BATH AND MEANS FOR SUPPLYING TONER TO THE TONER BATH

BACKGROUND OF THE INVENTION

1. Field of the Invention

This invention relates to apparatus for developing an electrostatic latent image formed on an image carrying substance with a dry developer by means of a magnetic brush development, and particularly to a developing apparatus using a magnetic toner of a one-component system as a dry developer.

2. Description of the Prior Art

In the fields of electronic photography, electrostatic recording and electrostatic printing, an electric latent image is formed on an image carrying substance and then developed by a magnetic brushing method using a magnetic developer, and the toner image thus developed is directly fixed on the image carrying substance or transferred normally to a sheet of paper or the like and then fixed thereon as a final image. As the image carrying substance, there are known an inorganic photoconductive material such as a photo-conductive selenium or a photosensitive material formed by dispersing photoconductive zinc oxide in an insulating resin binder, and an organic photoconductive material such as polyvinylcarbazole or poly-N-vinylcarbazole. These materials are used for electronic photograph copying machines and printers. Another known image carrying substance is an electrostatic recording paper having a dielectric layer mainly of an insulating resin formed on the conductive base paper, which is used in facsimile. The electric latent image in this invention includes electrostatic latent image, capacitive pattern, and conductive pattern, and the word "electrostatic latent image" containing them is used in the following description.

When an electrostatic latent image is developed by a magnetic brushing method, a mixture of ferromagnetic carrier particles and toner particles has been used as a magnetic developer. This ferromagnetic carrier particle is a core substance of iron powder, steel ball, ferrite powder, or the like, covered with a resin. The toner particle is formed by dispersing a coloring agent, such as pigment or dye, in a binder resin. Such a so-called two-component developing agent is used in a magnetic-brush type developing apparatus which, for example, is disclosed in the U.S. Pat. No. 3,697,050 (Stanly), or U.S. Pat. No. 3,703,395 (Drexler).

However, a one-component system magnetic toner has recently been used as a magnetic developing agent in the magnetic brush development, because it is unnecessary with such a one-component system magnetic toner to mix the carrier particles and toner particles, control the toner concentration in the developing agent, and interchange carrier particles. This magnetic toner, as, for example, disclosed in U.S. Pat. No. 3,639,245 (Nelson), U.S. Pat. No. 3,925,219 (Strong), and U.S. Pat. No. 4,189,390 (Mukon et al), contains chiefly a binder resin, and magnetic particles, and as necessary, added with an additive such as a conductive material, or a dye.

An apparatus for developing an electrostatic latent image using such a one-component magnetic toner, is, for example, disclosed in U.S. Pat. No. 4,021,571 (Nishihama et al), and, U.S. Pat. No. 4,231,370 (Asanae et al). In the example of Nishihama et al, a developing roll having a cylindrical non-magnetic sleeve and a cylindrical permanent magnet member provided in the sleeve is disposed to oppose a photosensitive material, and above the developing roll is disposed a toner bath with magnetic toner placed therein through its opening provided at its lower portion. In the example of Asanae et al, the developing roll disposed to oppose the photosensitive material is provided in the toner bath.

In these developing apparatuses, when the magnetic toner is supplied to the toner bath, the toner is generally poured therein by taking by hand a bottle or container of toner. However, this way of supplying toner will easily cause scattering of the toner and be difficult to supply constant toner to the toner bath. Thus, it is considered that a toner supply bath is provided in addition to the toner bath, and the container with toner is inserted into the toner supply bath to supply toner thereto, the toner within the toner supply bath being automatically supplied by the weight itself to the toner bath. In this case, however, after toner is filled in the toner bath, pressure in still exerted on the toner within the toner bath, and may cause the toner to be overflowed from the toner bath.

In U.S. Pat. No. 4,240,487 (Terashima et al), although means for detecting the amount of toner within the toner bath provided above the developing roll is included in the developing apparatus, no separate bath corresponding to the toner supply bath, from the toner bath is provided in this developing apparatus.

SUMMARY OF THE INVENTION

It is an object of the invention to provide a developing apparatus capable of preventing the magnetic toner from overflowing from the toner bath, with the above drawbacks obviated.

It is another object of the invention to provide a developing apparatus capable of supplying the toner swiftly and accurately.

According to the present invention, there is provided a developing apparatus with a magnetic toner comprising a developing roll having a cylindrical sleeve of non-magnetic material and a permanent magnet member with a plurality of magnetic poles on its surface, the magnetic member being provided in the sleeve, the developing roll being provided close to an image carrying substance having an electrostatic latent image held on its surface so that a developing gap is formed between the image carrying substance and the developing roll, the sleeve and the permanent magnet member being relatively rotated to carry a magnetic toner on the surface of the sleeve toward the developing gap; a toner bath having the magnetic toner entered therein through an opening thereof provided above the sleeve; a toner supply bath provided to communicate with the toner bath through a supply path provided below the toner supply bath, thereby supplying the magnetic toner to the toner bath; a detector member provided at the toner bath for detecting the presence or absence of the magnetic toner within the toner bath and for generating a signal when a predetermined amount of the magnetic toner is absent therein, magnetic field generating means provided around the supply path so as to magnetically shut off the supply path; and drive means for moving the magnetic field generating means relative to the supply path in response to the signal so that when the signal is not generated from the detector member, the supply path is magnetically shut off, and when the signal is generated therefrom, the supply path is magnetically released from the closed state.

DESCRIPTION OF THE PREFERRED EMBODIMENTS

Figure 1:
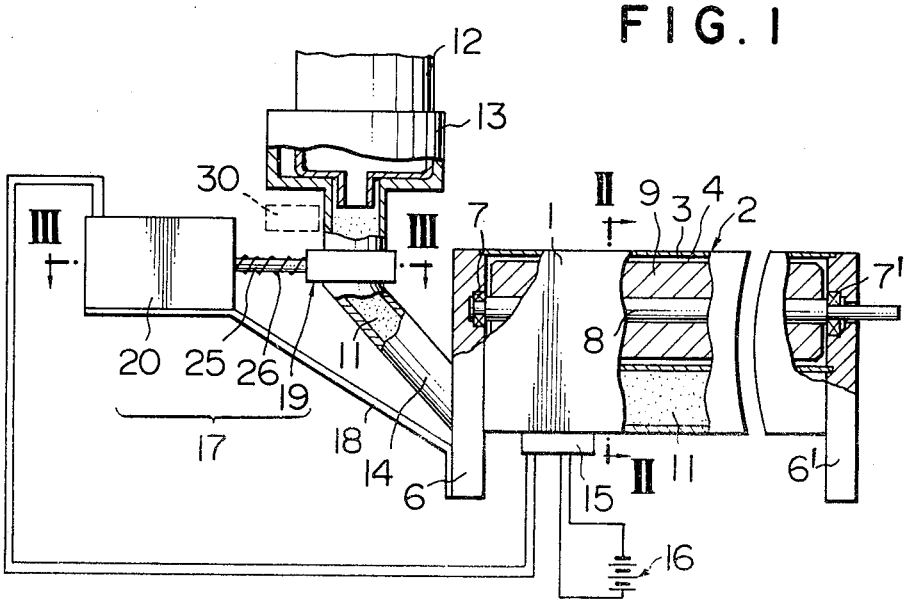
FIG. 1 is a front view of a developing apparatus showing an embodiment of the invention.
Figure 2:
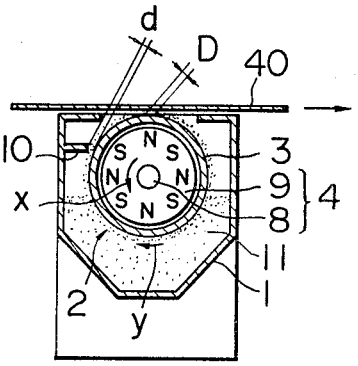
FIG. 2 is a cross-sectional view taken along line II—II in FIG. 1.

Referring to FIGS. 1 and 2, a toner bath 1 with the top opened is supported at its sides by a pair of side plates 6 and 6' and has a developing roll 2 disposed therein to oppose a sheet-like recording body 40. The developing role 2 has a cylindrical sleeve 3 of non-magnetic material and a permanent magnet member 4 rotatably disposed in the sleeve 3. The permanent magnet member 4 has a shaft 8 supported via a bearing 7 by the side plates 6 and 6' and a cylindrical permanent magnet 9 fixed around the shaft 8. The permanent magnet 9 has a plurality of magnetic poles (N, S) along its outer peripheral surface, each of the magnetic poles extending in the axial direction, and the shaft 8 of the developing roll 2 is driven by an external drive source (not shown).

As shown in FIG. 2, the sleeve 3 is fixed and the permanent magnet member 4 is rotated in the counter-clockwise direction, or in the direction of an arrow x. The recording medium 40 opposite the sleeve 3 of the developing roll 2 with a gap D (hereinafter, referred to as developing gap) therebetween, and upstream of the recording medium 40 there is provided a doctor blade 10 and a doctor gap d is formed between the tip end of the doctor blade 10 and the sleeve 3.

On one side of the toner bath 1 there is disposed a toner container 13 holding a toner bottle 12 having a magnetic toner 11 therein. The toner container 13 is communicated with the toner bath 1 via a chute 14.

In the toner bath 1 is placed a sensor 15 for detecting the presence or absence of the magnetic toner 11 therein. The sensor 15 has a switch (not shown) electrically connected to a DC voltage source 16. This switch is turned off when a predetermined amount of magnetic toner is present in the toner bath 1, but turned on when the toner bath 1 has a deficient amount of magnetic toner, to send an external signal.

The sensor 15 may be a sensor for detecting the amount of toner by a change of inductance of sensor coil as, for example, disclosed by Terashima et al, a sensor for detecting the amount of toner by a change of electrically resonant condition due to the vibrating condition of an acoustic element, or the like.

Figure 3:
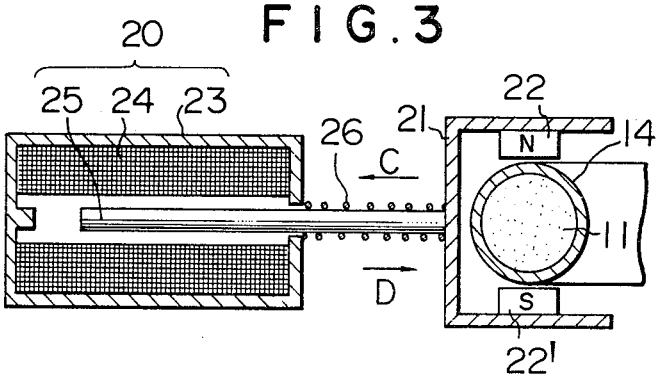
FIG. 3 is a cross-sectional view taken along line III—III in FIG. 1.

Referring to FIGS. 1 and 3, the supply of magnetic toner to the toner bath 1 is controlled by a toner supply controller 17 which is supported by an arm 18 fixed to the side plate 6. The toner supply controller 17 is formed of a magnetic shutter member 19 and a drive member 20. The magnetic shutter member 19 has a movable piece 21 surrounding the chute 14 and a pair of permanent magnets 22 and 22' fixed to the movable piece 21. These permanent magnets 22 and 22' are disposed so that their poles oppose each other, thereby establishing a magnetic field within the chute 14. The drive member 20 is a so-called electromagnetic solenoid having a cylindrical yoke 23 of a ferromagnetic material, an electromagnetic coil 24 mounted in the yoke 23 and a movable iron core 25 inserted in the coil 24. The movable piece 21 of the magnetic shutter member 19 is connected to the movable iron core 25, and a compression coil spring 26 is mounted between the movable piece 21 and the yoke 23. The electromagnetic coil 24 is electrically connected to the switch of the sensor 15, and when the switch is turned on, a current flows in the coil 24.

The operation of the developing apparatus will be described below. When the toner bottle 12 is turned upside down and inserted in the toner container 13, the magnetic toner 11 is supplied through the chute 14 to within the toner bath 1. Then, when the permanent magnet member 4 is rotated in the X-arrow direction as indicated, the magnetic toner 11 adhered onto the sleeve 3 is carried in the direction of an arrow y. A magnetic brush thus formed is restricted in its height by the doctor blade 10 and at the developing gap D, it brushes the surface of the recording medium 40, developing the latent image (not shown).

In this case, when a predetermined amount of magnetic toner 11 exists in the toner bath 1, the switch of the sensor 15 is in the off-state, and therefore a current is not flowed in the electromagnetic coil 24. Consequently, the magnetic field from the permanent magnets 22 and 22' acts on the chute 14, magnetically shutting off the shoot 14 so that the magnetic toner 11 is not fed from the shoot 14 to within the toner bath 1.

Then, as developing is repeated and the magnetic toner 11 is consumed, the amount of the magnetic toner 11 within the toner bath 1 is decreased. When the amount of the magnetic toner 11 within the toner bath 1 is reduced below the predetermined value, the switch of the sensor 15 is turned on, permitting a current to flow in the electromagnetic coil 24. At this time, the movable score 25 is electromagnetically attracted by the yoke 23 into the electromagnetic coil 24, or moved in the direction of an arrow C. Thus, since the permanent magnets 22 and 22' fixed to the movable piece 21 go away from the chute 14, the chute 14 is released from the magnetically shut-off condition, allowing the magnetic toner 11 to be fed to the toner bath 1. When the amount of the magnetic toner 11 within the toner bath 1 reaches the predetermined value, the switch of the sensor 15 is again turned off. Consequently, the current flow in the electromagnetic coil 24 stops and thus the compression coil spring 26 exerts its restoring force on the movable core 25 to move it in the direction of an arrow D. The permanent magnets 22 and 22' return to the original position, thus again magnetically shutting off the chute 14.

As described above, the developing apparatus functions to detect the amount of toner left in the toner bath, and automatically controls the supply of toner to the toner bath in accordance with the remaining amount of toner in the bath, thereby preventing the toner from overflowing and permitting precise control of toner supply because the toner supply is controlled at a high response speed.

If such toner supply controller is not provided in the developing apparatus, the magnetic toner will be moved through the chute to the toner bath by naturally falling due to gravity and will be acted on by pressure after the predetermined amount of magnetic toner has been filled in the toner bath, resulting in overflowing from the toner bath.

Figure 4:
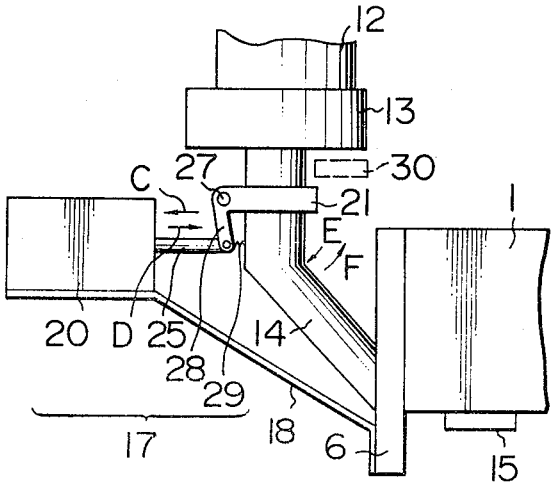
FIG. 4 is a front view of a developing apparatus showing a modification of FIG. 1.

While in the above embodiment the movable piece of the toner supply controller is moved in the horizontal direction, such a modification as shown in FIG. 4 is possible. In FIG. 4, the arrangement of the developing apparatus except the support mechanism of the movable piece is the same as that of FIG. 1. In this case, the movable piece 21 is pivoted by a pin 27 fixed at a certain position, and an arm 28 of the movable piece 21 is connected to the movable core 25. A coil spring 29 has one end fixed to the chute 14 and the other end connected to the arm 28.

With such arrangement, when the movable core 25 is moved in the arrow-c direction by the signal from the sensor 15, the movable piece 21 is rotated about the pin 27 in the direction of an arrow E to release the chute 14 from the magnetic field with result that the magnetic toner 11 is supplied from the chute 14 to within the toner bath 1. When the amount of the magnetic toner within the toner bath 1 reaches the predetermined value, the current flow in the electromagnetic coil stops and, therefore the coil spring 29 exerts a restoring force on the movable core 25 to return it to the original position. Consequently, the movable piece 21 rotates in the direction of an arrow F, again magnetically shutting off the chute 14 to stop the magnetic toner 11 from being supplied from the chute 14 to the toner bath 1.

Moreover, in FIGS. 1 and 4, a sensor 30 (indicated by a broken line in FIGS. 1 and 4) for detecting the amount of magnetic toner within the chute 14 may be provided about the opening of the toner container 13. The sensor 30 is electrically connected to a power supply for driving the permanent magnet member 4, and to the drive means for the toner supply controller, and a switch of the sensor 30 is turned on when the toner 11 exists in the chute 14, but turned off when no toner 11 exists in the chute 14.

In this arrangement, when the toner 11 is present in the chute 14, the developing operation is made, but when the toner 11 becomes absent, the power is cut off to stop the developing operation. In other words, by providing the sensor 30, it is possible to automatically stop the operation of the developing apparatus when the toner container is emptied. Moreover, the sensor 30 may be connected with an alarm device such as a lamp or buzzer for giving an alarm for deficient amount of toner.

Other modifications of the developing apparatus of the invention may be made as follows:

(1) For carrying the toner on the sleeve, the sleeve may be rotated with the permanent magnet member fixed, or the permanent magnet member and the sleeve may be rotated in the same direction or in opposite directions.

(2) The electromagnetic drive member may be of movable coil type or movable electromagnet type.

(3) The invention is applicable to a developing apparatus having a hopper-like container with an opening at its lower portion used as the toner bath and the developing roll provided under the container, in which the toner is supplied to the developing apparatus from a second hopper of a large capacity.

According to this invention, as described above, the magnetic toner can be supplied to within the developing apparatus from the toner container provided separately from the developing apparatus body and the supply of the toner can be controlled accurately and automatically, thus completely preventing the toner from overflowing from the developing apparatus.

We claim:

1. A developing apparatus with a magnetic toner comprising:

a developing roll having a cylindrical sleeve of non-magnetic material and a permanent magnet member with a plurality of magnetic poles on its surface, said magnetic member being provided in said sleeve, said developing roll being provided close to an image carrying substance having an electrostatic latent image held on its surface so that a developing gap is formed between said image carrying substance and said developing roll, said sleeve and said permanent magnet member being relatively rotated to carry a magnetic toner on the surface of said sleeve toward the developing gap;

a toner bath adapted to have the magnetic toner supplied thereto through an opening thereof;

a toner supply bath provided to communicate with said toner bath through a supply path provided below the toner supply bath, thereby supplying the magnetic toner to said toner bath;

a detector member provided at said toner bath for detecting the presence or absence of the magnetic toner within said toner bath and for generating a signal when a predetermined amount of the magnetic toner is absent therein;

magnetic field generating means provided around said supply path for transversely generating a magnetic flux relative to the axis of said supply path to magnetically shut off said supply path, wherein said magnetic field generating means comprises magnetic circuit means including a pair of permanent magnets straddling the supply path and a supporting member for fixing the permanent magnets thereon and arranging the permanent magnets to interpose the supply path; and drive means for moving said magnetic field generating means relative to said supply path in response to said signal so that when said signal is not generated from said detector member, said supply path is magnetically shut off, and when the signal is generated therefrom, said supply path is magnetically released from the closed state.

2. A developing apparatus according to claim 1, wherein said drive means comprises an electromagnetic drive means having an electromagnetic coil and a movable iron core inserted therein.

3. A developing apparatus according to claim 1 or 2, wherein said apparatus further comprises another detector member for detecting the amount of the magnetic toner in the supply bath provided above the supply path.

4. A developing apparatus according to claim 3, wherein said drive means and said developing roll are controlled to operate and stop in accordance with the amount of toner within the supply path detected by said another detector member.

5. A developing apparatus according to claim 1, further including pivoting means, to which the magnetic field generating means is attached and around which the magnetic field generating means moves, and wherein said drive means is adapted to move said magnetic field generating means in an arc from a position where the supply path is magnetically shut off to a position where the supply path is released from the closed state.

6. A developing apparatus according to claim 3, wherein said toner bath has its opening provided at its upper portion and said developing roll faces said opening.

7. A developing apparatus according to claim 4, wherein said toner bath has its opening provided at its upper portion and said developing roll faces said opening.

8. A developing apparatus with a magnetic toner comprising:

a developing roll having a cylindrical sleeve of non-magnetic material and a permanent magnet member with a plurality of magnetic poles on its surface, said magnetic member being provided in said sleeve, said developing roll being provided close to an image carrying substance having an electrostatic latent image held on its surface so that a developing gap is formed between said image carrying substance and said developing roll, said sleeve and said permanent magnet member being relatively rotated to carry a magnetic toner on the surface of said sleeve toward the developing gap;

a toner bath adapted to have the magnetic toner supplied thereto through an opening thereof;

a toner supply bath provided to communicate with said toner bath through a supply path provided below the toner supply bath, thereby supplying the magnetic toner to said toner bath;

a detector member provided at said toner bath for detecting the presence or absence of the magnetic toner within said toner bath and for generating a signal when a predetermined amount of the magnetic toner is absent therein;

magnetic field generating means provided around said supply path for transversely generating a magnetic flux relative to the axis of said supply path to magnetically shut off said supply path, wherein said magnetic field generating means is adapted to move in a straight line from a position where the supply path is magnetically shut off to a position where the supply path is released from the closed state, and said drive means is adapted to move said magnetic field generating means in a straight line; and drive means for moving said magnetic field generating means relative to said supply path in response to said signal so that when the signal is not generated from said detector member, said supply path is magnetically shut off, and when the signal is generated therefrom, said supply path is magnetically released from the closed state.

* * * * *